US005576732A

United States Patent [19]

Minakuchi et al.

[11] Patent Number: 5,576,732

[45] Date of Patent: Nov. 19, 1996

[54] DYNAMIC IMAGE DISPLAY DEVICE

[75] Inventors: Yu Minakuchi; Satoshi Okuyama; Toshimitsu Suzuki; Katsutoshi Yano, all of Kawasaki, Japan

[73] Assignee: Fujitsu Limited, Kawasaki, Japan

[21] Appl. No.: 463,922

[22] Filed: Jun. 5, 1995

Related U.S. Application Data

[62] Division of Ser. No. 269,779, Jul. 1, 1994.

[30] Foreign Application Priority Data

Jul. 22, 1993 [JP] Japan ..... 5-181678

[51] Int. Cl.[6] ..... G09G 5/00

[52] U.S. Cl. ..... 345/127; 345/114; 345/115

[58] Field of Search ..... 345/127, 118, 345/119, 115, 129, 130, 132, 122, 114

[56] References Cited

U.S. PATENT DOCUMENTS

| | | | |
|---|---|---|---|
| 4,947,257 | 8/1990 | Fernandez et al. | 345/122 |
| 4,990,902 | 2/1991 | Zenda | 395/127 |
| 5,404,437 | 4/1995 | Nguyen | 345/122 |

FOREIGN PATENT DOCUMENTS

| | | | |
|---|---|---|---|
| 4138453A1 | 5/1992 | Germany . | |
| 4098290 | 3/1992 | Japan | 345/127 |
| 4-199281 | 7/1992 | Japan . | |
| 548645A1 | 6/1993 | WIPO . | |

OTHER PUBLICATIONS

Maier, M.: Fenstertechnik auf dem Chip. In: Elektronik 23/13.11.87 S. 96–104.

*Primary Examiner*—Mark R. Powell
*Assistant Examiner*—Matthew Luu
*Attorney, Agent, or Firm*—Staas & Halsey

[57] ABSTRACT

A dynamic image display device which successively reads out each frame from dynamic image data stored as successive frames to display each of the frames at each predetermined display period on a window of a display device. The predetermined display period is changeable. The dynamic image display device includes a distance parameter input device for inputting a distance parameter between a display screen displaying the window and a person looking at a dynamic image on the display screen, a storage device having a definition correlating the distance parameter with the predetermined display period, a device for reading out from the storage device the predetermined display period corresponding to the distance parameter inputted by the distance parameter input device, and a device for displaying each of the frames on the window of the display device during each predetermined display period.

1 Claim, 15 Drawing Sheets

| SIZE RATIO OF DISPLAY AREA SIZE | 100 | 90 | 80 | ••• |
|---|---|---|---|---|
| DISPLAY PERIOD [msec/ 1 FRAME ] | 30 | 33 | 36 | ••• |

| SIZE RATIO OF DISPLAY AREA SIZE | 100 | 90 | 80 | ... |
|---|---|---|---|---|
| JUMPING NUMBER | 0 | 1 | 2 | ... |

| SIZE RATIO OF DISPLAY SCREEN SIZE | 100 | 90 | 80 | ••• |
|---|---|---|---|---|
| DISPLAY PERIOD [msec/1 FRAME] | 40 | 39 | 38 | ••• |

| SIZE RATIO OF DISPLAY SCREEN SIZE | 100 | 90 | 80 | ... |
|---|---|---|---|---|
| JUMPING NUMBER | 2 | 1 | 0 | ... |

| SIZE RATIO OF DISTANCE PARAMETER | 100 | 90 | 80 | ... |
|---|---|---|---|---|
| DISPLAY PERIOD [msec / 1 FRAME] | 30 | 33 | 36 | ... |

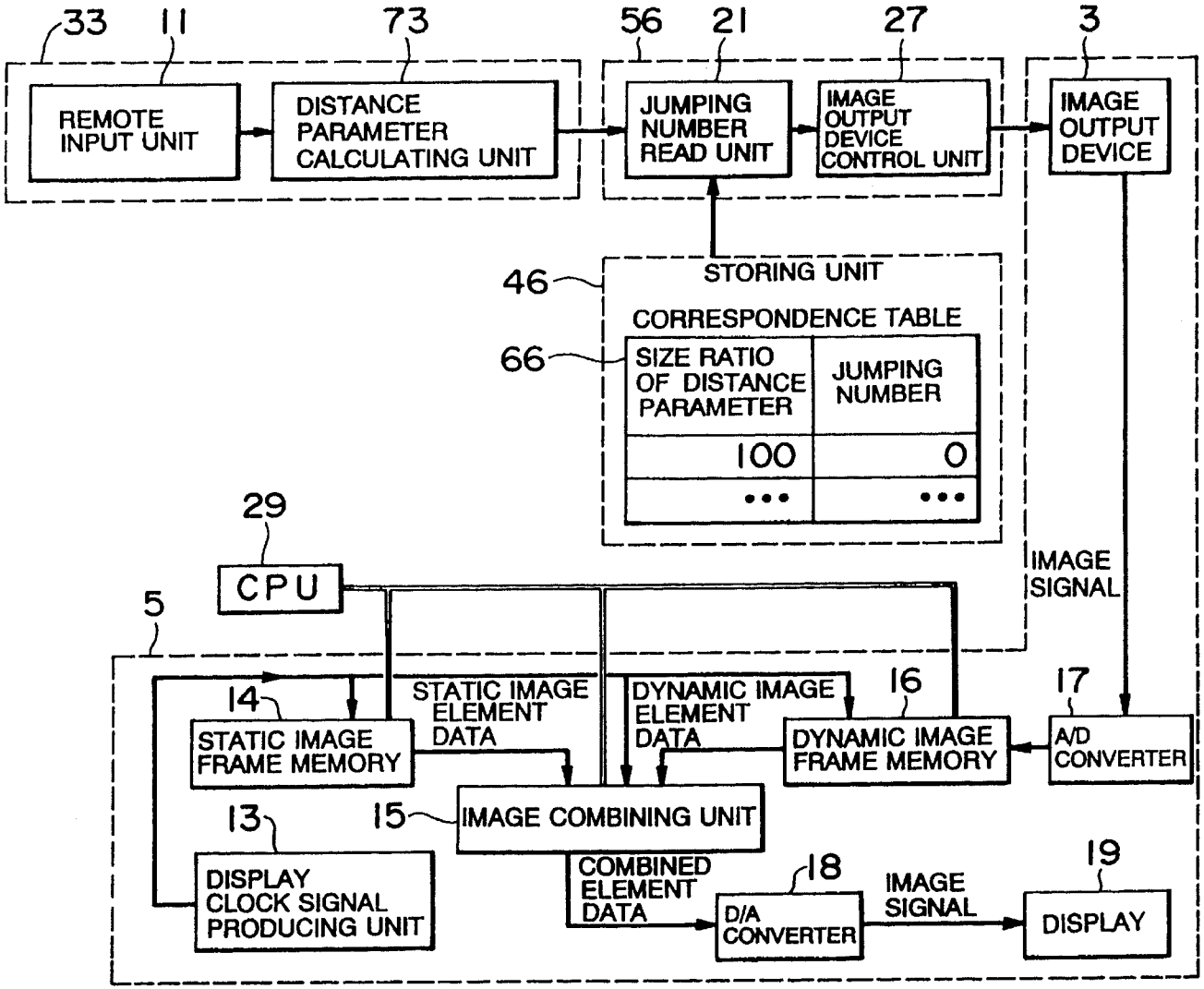
FIG.19
REMOTE INPUT UNIT
DISTANCE PARAMETER CALCULATING UNIT
JUMPING NUMBER READ UNIT
IMAGE OUTPUT DEVICE CONTROL UNIT
IMAGE OUTPUT DEVICE
STORING UNIT
CORRESPONDENCE TABLE
SIZE RATIO OF DISTANCE PARAMETER
JUMPING NUMBER
100
0
CPU
IMAGE SIGNAL
A/D CONVERTER
DYNAMIC IMAGE FRAME MEMORY
DYNAMIC IMAGE ELEMENT DATA
STATIC IMAGE ELEMENT DATA
STATIC IMAGE FRAME MEMORY
IMAGE COMBINING UNIT
COMBINED ELEMENT DATA
D/A CONVERTER
IMAGE SIGNAL
DISPLAY
DISPLAY CLOCK SIGNAL PRODUCING UNIT
33
11
73
56
21
27
3
46
66
29
5
14
13
15
16
17
18
19

| SIZE RATIO OF DISTANCE PARAMETER | 100 | 90 | 80 | ... |
|---|---|---|---|---|
| JUMPING NUMBER | 0 | 1 | 2 | ... |

DX : DISTANCE BETWEEN DISPLAY SCREEN AND USER
DISPH : HALF HEIGHT LENGTH OF DISPLAY SCREEN
DISPW : HALF WIDTH LENGTH OF DISPLAY SCREEN
a, β : DISTANCE PARAMETER

DYNAMIC IMAGE DISPLAY DEVICE

This application is a division of application Ser. No. 08/269,779, filed Jul. 1, 1994, now pending.

BACKGROUND OF THE INVENTION

1. Field of the Invention

The present invention relates to a dynamic image display device for an information processing equipment such as a work station.

2. Description of the Related Art

A work station or the like is provided with a multi-window system having one screen of a display device display a plurality of regions (hereinafter, referred to as "windows") each of which indicates one piece of information so that the device indicates a plurality of pieces of information, simultaneously. One of the windows may be located not to be on top of the other or may be located to completely or partially to be on top of the other.

In this case, a user using the work station can freely change the display position or the display area size of each of the windows, taking these into consideration. It is known that there is means for achieving this end in which the display position or the display area size of each of the windows is changed by an input device such as a key board or a mouse in accordance with the information inputted.

However, the multi-window system has a problem that a feeling of speed and a feeling of weight of the dynamic image being displayed are changed after a change of the display area size.

In addition, even if the window is recognized as the same display area size in the information processing equipment, the feeling of speed and the feeling of weight of the dynamic image being displayed are changed after a change of the display area size of the window.

Furthermore, the display area size of the window is changed even by a distance between the display and the user. As a result of this, the feeling of speed and the feeling of weight of the dynamic image being displayed are changed.

SUMMARY OF THE INVENTION

It is therefore an object of the present invention to provide a dynamic image display device which a feeling of speed and a feeling of weight are not changed even if the display area size, the display screen size or the distance parameter is changed.

Other objects of the present invention will become clear as the description proceeds.

The foregoing objects and advantages are achieved by way of the present invention which provides with following construction. The description will now be made referring to FIG. 1.

According to the present invention, there is provided a dynamic image display device generally designated by the reference numeral 10, successively reading out each of frames from dynamic image data stored as successive frames to display each of said frames at each of predetermined display periods on a window of display unit 5. The dynamic image display device 10 comprises a display area size input unit 31, a storing unit 41 and a dynamic display control unit 51.

The display area size input unit 31 inputs the display area size of the window.

The storing unit 41 has a correspondence table 61 corresponding the display area size with the display period.

The dynamic display control unit 51 reads out from the storing unit 41 each of the display periods corresponding to the display area size of the window inputted in the display area size input unit 31 and controls to display each of the frames on the window of the display unit 5 at each of the display periods.

Further, the present invention is capable of being provides with each of the following constructions (i)~(v).

(i) A dynamic image display device successively reading out each of frames from dynamic image data stored as successive frames every predetermined jumping number to display each of the frames read out at each of predetermined display periods on a window of display unit 5, comprises display area size input unit 32, storing unit 42 and dynamic image display control unit 52.

The display area size input unit 31 inputs the display area size of the window.

The storing unit 42 has a correspondence table 62 corresponding the display area size with the jumping number.

The dynamic display control unit 52 reads out from the storing unit 42 the jumping number corresponding to the display area size of the window inputted in the display area size input unit 31 and controls to display each of the frames on the window of the display unit 5 every jumping number.

(ii) A dynamic image display device successively reading out each of frames from dynamic image data stored as successive frames to display each of the frames at each of predetermined display periods on a window of display unit 5, comprises display screen size input unit 32, storing unit 43 and dynamic display control unit.

The display screen size input unit 32 inputs the display screen size of the window.

The storing unit 43 has a correspondence table 63 corresponding the display screen size with the display period.

The dynamic display control unit 53 reads out from the storing unit 43 each of the display periods corresponding to the display screen size of the window inputted in the display screen size input unit 32 and controls to display each of the frames on the window of the display unit 5 at each of the display periods.

(iii) A dynamic image display device reading out each of frames from dynamic image data stored as successive frames every predetermined jumping number to display each of the frames at each of predetermined display periods on a window of display unit 5, comprises display screen size input unit 32, storing unit 44 and dynamic display control unit 54.

The display screen size input unit 32 for inputs the display screen size of the window.

The storing unit 44 has a correspondence table 64 corresponding the display screen size with the jumping number.

The dynamic display control unit 54 reads out from the storing unit 44 the jumping number corresponding to the display screen size of the window inputted in the display screen size input unit 32 and controls to display each of the frames from the dynamic image data every jumping number read out.

(iv) A dynamic image display device successively reading out each of frames from dynamic image data stored as successive frames to display each of the frames at each of predetermined display periods on a window of display 5, comprises distance parameter input unit 33, storing 45 and dynamic display control unit 55.

The distance parameter input unit 33 inputs the distance parameter between a display screen displaying the window and a person looking the dynamic image.

The storing unit 45 has a correspondence table 65 corresponding the distance parameter with the display period.

The dynamic display control unit 55 reads out from the storing unit 45 each of the display periods corresponding to the distance parameter inputted in the distance parameter input unit 33 and controls to display on the window of the display unit 5 each of the frames read out at each of the display periods.

(v). A dynamic image display device reading out each of frames from dynamic image data stored as successive frames every predetermined jumping number to display each of the frames at each of predetermined display periods on a window of display unit 5, comprises distance parameter input unit 33, storing unit 46 and dynamic display control unit 56.

The distance parameter input unit 33 inputs a distance parameter between a display screen displaying the window and a person looking the dynamic image.

The storing unit 46 has a correspondence table 64 corresponding the distance parameter with the jumping number.

The dynamic display control 56 reads out from the storing unit 44 the jumping number corresponding to the distance parameter inputted in the distance parameter input unit 32 and controls to display each of the frames from the dynamic image data every jumping number read out.

In the description mentioned above, the display area size input unit 31 comprises a pointing unit such as a mouse, track ball or a cursor key and a microprocessor.

The display screen size input unit 32 comprises a value input device such as a key board or a switch and a microprocessor.

The distance parameter input unit 33 comprises a value input device such as a key board or switch and a microprocessor.

Each of the storing unit 41, 42, 43, 44, 45, 46 may be a semiconductor memory, a magnetic storage, or an optical storage.

Each of the dynamic display control unit 51, 52, 53, 54, 55, 56 comprises an interface device based on RS-232C standard, GP-IB standard or the like.

The display area size may be one of the followings (a)~(d).

(a) a length of a diagonal line of the window (b) a height length of the window (c) a width length of the window (d) an area of the window The display screen size may be one of the followings (a)~(d).

(a) a length of a diagonal line of the window (b) a height length of the window (c) a width length of the window (d) an area of the window The distance parameter may be one of the followings (a)~(c) (see FIG. 22).

(a) an angle calculated by the following equation wherein DX indicates a distance between the display screen displaying the windows and the person looking the dynamic image and DISPH indicates a height length of the display screen of the display unit 5.

$\tan^{-1}$ (DISPH / 2DX)

(b) an angle calculated by the following equation wherein DX indicates a distance between the display screen displaying the windows and the person looking the dynamic image and DISPW indicates a width length of the display screen of the display unit 5.

$\tan^{-1}$ (DISPW / 2DX)

(c) a distance between the screen indicating and the person looking the dynamic image.

BRIEF DESCRIPTION OF THE DRAWINGS

FIG. 19 is a structural block diagram showing a sixth embodiment of the present invention;

DETAILED DESCRIPTION OF THE PREFERRED EMBODIMENTS

The present invention will now be described in detail with reference to six preferred embodiments thereof, i.e. a first embodiment through a sixth embodiment.

First Embodiment

In the first embodiment, it is assumed that a feeling of speed for a movement of a dynamic image is higher and higher as a display area size of a window being displayed is smaller. The feeling of speed is amended by changing a display period of a frame.

In the first embodiment, the term "display area size" is used as a length of a diagonal line of the window.

(Construction of The First Embodiment)

Figure 4:
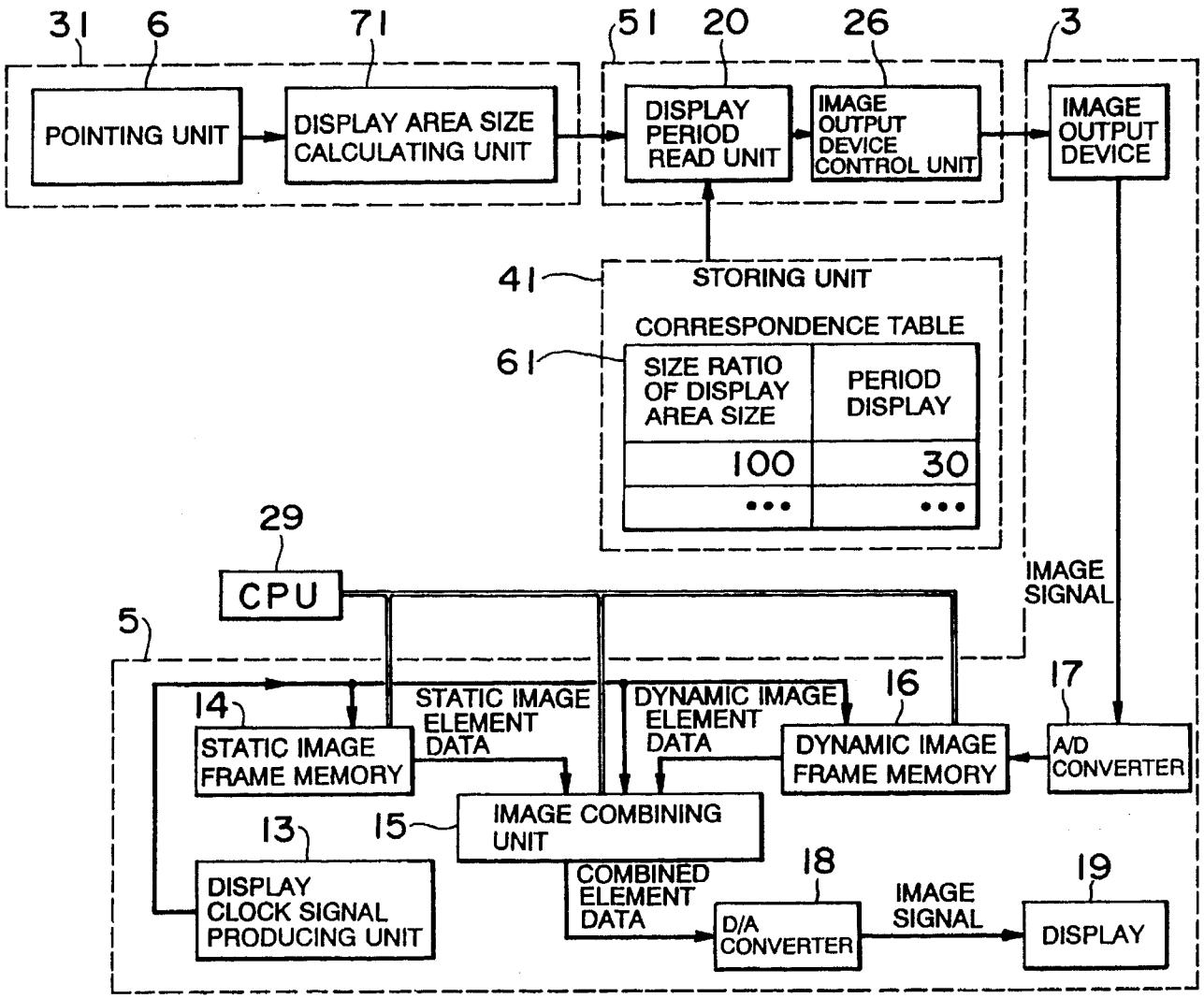
FIG. 4 is a structural block diagram showing a first embodiment of the present invention.

The description will now be made as regard to a construction of the first embodiment referring to FIG. 4.

The first embodiment comprises the followings (i)~(iv):

(i) A display unit 5 combining each of frames successively read out from dynamic image data stored as successive frames in a VTR (video tape recorder) tape with each of frames produced from static image data by functions of a microprocessor and a frame memory to display each of combined frames on a window of a display at each of predetermined display periods;

(ii) A display area size input unit 31 inputting a display area size of the window by a pointing unit;

(iii) A storing unit 41 storing a correspondence relationship 61 between the display area size and the display period into a semiconductor memory; and (iv) A dynamic image display controlling unit 51 reading out from the storing unit 41 by functions of an interface unit and a microprocessor each of the display periods corresponding to the display area size inputted in the display area size input unit 31 to control so as to display each of the combined frames on the window of the display unit 5 at each of the display periods read out.

The description will now be made in detail as regard to the construction of the first embodiment.

The display area size input unit 31 comprises the pointing unit 6 and a display area size calculating unit 71.

Figures 5, 6:
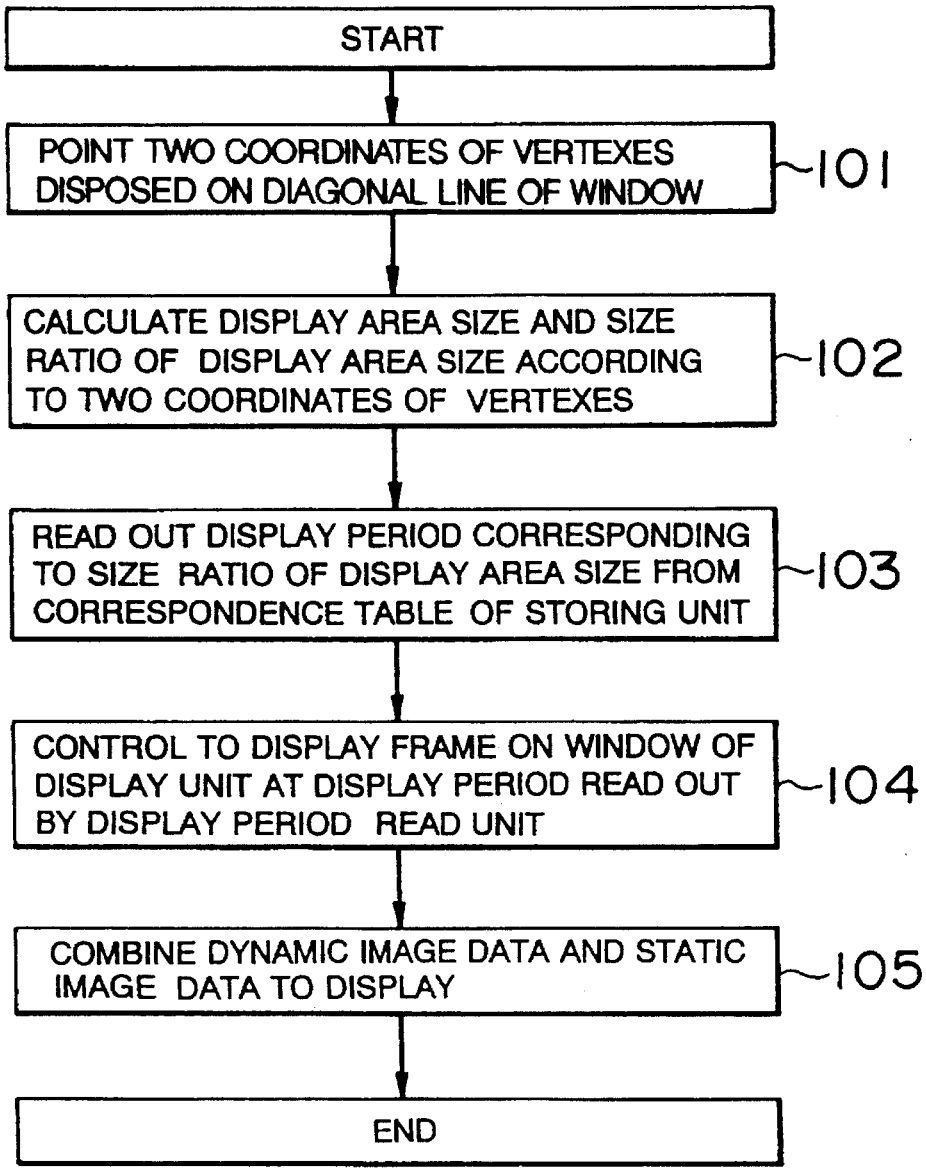
FIG. 5 is a view for use in corresponding a size ratio of the display area size with the display period according to the first embodiment of the present invention.
FIG. 6 is a flow chart showing the first embodiment of the present invention.

The storing unit 41 has a correspondence table 61 (See FIG. 5).

The dynamic image display controlling unit 51 comprises a display period read unit 20 and an image output device control unit 26.

The display unit 5 comprises an image output device 3, a display clock signal producing unit 13, a static image frame memory 14, an A/D converter 18, and a display 19.

The pointing unit 6 points two coordinates indicating vertexes disposed on a diagonal line of the window. The pointing unit 6 may be a mouse, a digitizer, a light-pen or the like. The pointing unit 6 is connected to the display area size calculating unit 71.

The display area size calculating unit 71 calculates a distance between the two coordinates designated by the pointing unit 6, i.e. the display area size, and calculates a size ratio of the display area size according to the display area size calculated. The size ratio of the display area size is a percentage of the actual display size against the maximum display area size to be previously estimated. The display period read unit 20 is connected to the display area size calculating unit 71.

The display period read unit 20 inputs the size ratio of the display area size calculated by the display area size calculating unit 71 to read out from a table 61 of the storing unit 41 the display period corresponding to the size ratio of the display area size inputted. The image output device control unit 26 is connected to the display period read unit 20.

The image output device control unit 26 controls to display each of the combined frames on the window of the display unit 5 at each of the display periods read out by the display period read unit 20. The image output device 3 is connected to the image output device control unit 26.

The image output device 3 successively reads out the frames from the dynamic image data stored as the successive frames to output the frames. The image output device 3 may be a VTR, a laser disc or the like. The A/D converter 17 is connected to the image output device 3.

The display clock signal producing unit 13 produces a clock signal for recognizing a vertex of the display screen and a clock signal for displaying an image element (pixel or dot) on the display screen. These clock signals are supplied to a static image frame memory 14, a dynamic image frame memory 16 and an image combining unit 15.

The A/D converter 17 converts an analog image signal outputted from the image output device 3 to a signal in digital form. The dynamic frame memory 16 is connected to the A/D converter 17.

The dynamic image frame memory 16 storing a digital image signal outputted from the A/D converter 17 as a frame comprises a display position assignment register **16*a*, a display size assignment register 16*b*, a dynamic image storing position register 16*c* and a frame memory 16*d*. The display position assignment register 16 stores coordinates indicating vertexes on the display screen. The display size assignment register 16*c* stores a height size and a width size of the window. The frame memory 16*d* stores coordinates indicating vertexes of the window on the frame memory 16*d*. The frame memory 16*d* stores the digital image signal outputted from the A/D converter 17 as a frame. The image combining unit 15 is connected to the dynamic frame memory 16**.

The image combining unit 15 inputs static image element data supplied from the static image frame memory 14 and dynamic image element data outputted from the dynamic image frame memory 16 and then combines these image element data. The image combining unit 15 comprises a display position assignment register **15*a* and a display size assignment register 15*b*. The display position assignment register 15*a* stores the coordinates indicating the vertexes of the display screen. The display size assignment register 15*b* stores the height size and the width size of the window. The D/A converter 18 is connected to the image combining unit 15**.

The D/A converter 18 inputs digital combined image element data outputted from the image combining unit 15 to convert to signals in analog form. The display 19 is connected to the D/A converter 18.

The display 19 displays the analog image signals outputted from the D/A converter 18. The display may be, for example, a CRT (Cathode Ray Tube).

(Function of The First Embodiment)

The operational routine of the first embodiment will be now described referring to FIG. 6.

First, the pointing unit 6 points the two coordinates indicating vertexes disposed on the diagonal line of the window (Step 101).

The display area size calculating unit 71 then calculates the distance between the two coordinates designated by the pointing unit 6, i.e. the display area size, and calculates the size ratio of the display area size according to the display area size calculated (Step 102).

Next, the display period read unit 20 inputs the size ratio of the display area size calculated by the display area size calculating unit 71 to read out from the table 61 of the storing unit 41 the display period corresponding to the size ratio of the display area size inputted (Step 103). For example, in FIG. 5, a value of 30(msec/frame) is read out as a display period when the size ratio of the display area size is 90.

The image output device control unit 26 controls to display each of the combined frames on the window of the display unit 5 at each of the display periods read out by the display period read unit 20 (Step 104).

Next, the display unit 5 combines the static image data with the dynamic image data to display the combined image data by processing the following steps (i)~(v) (Step 105).

Figure 1:
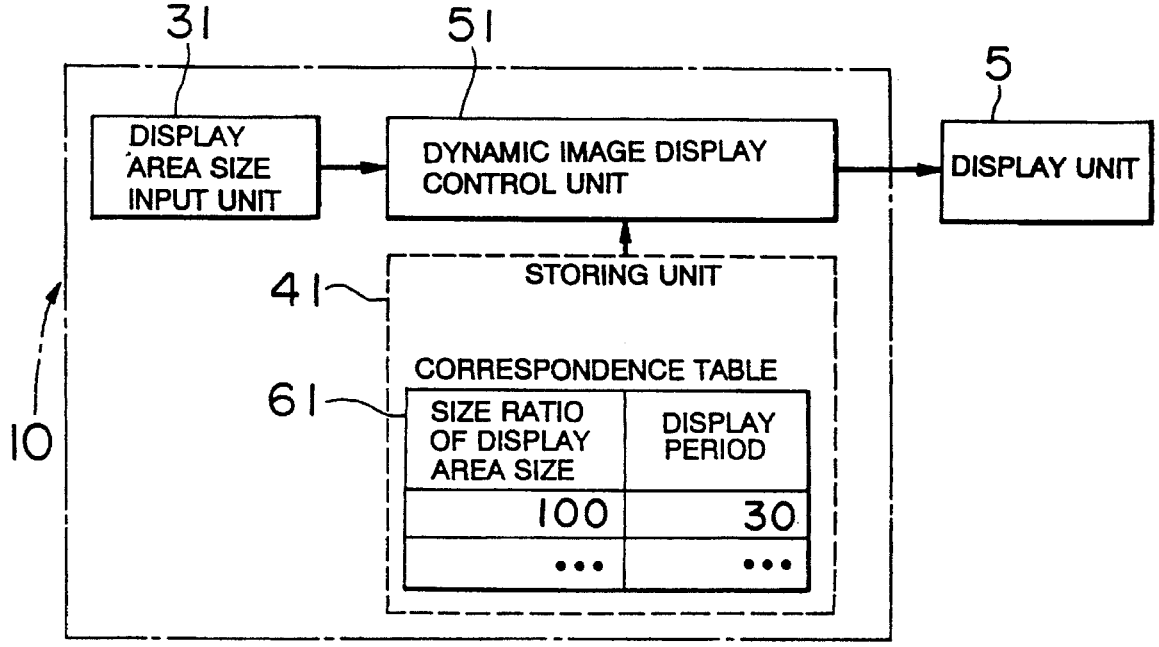
FIG. 1 is a principle view showing a dynamic image display device of the present invention.
Figure 2:
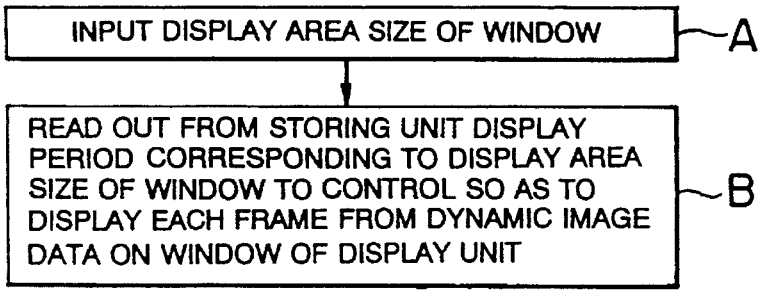
FIG. 2 is a principle flow showing a dynamic image display device of the present invention.
Figure 3:
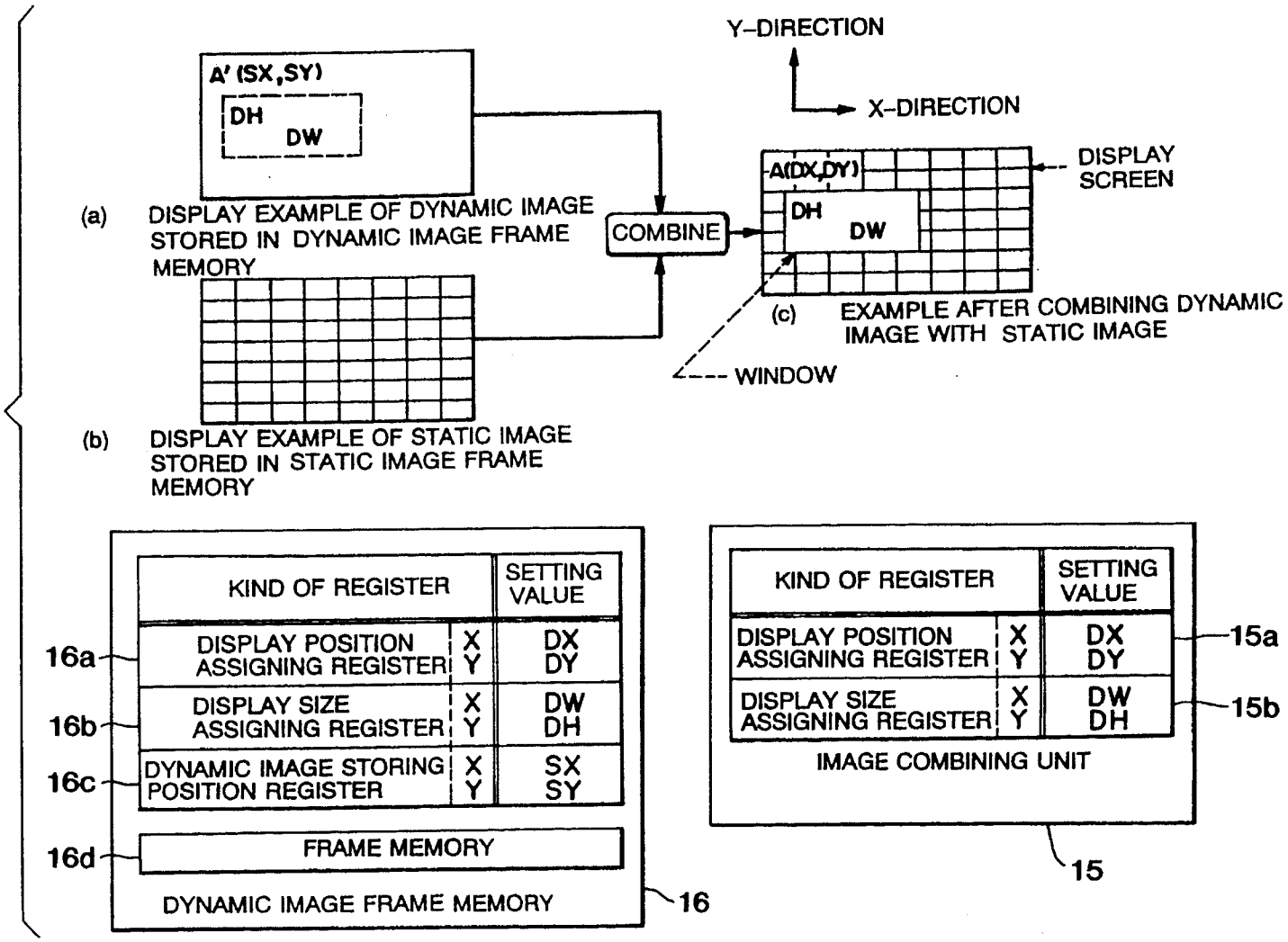
FIG. 3 is a diagram for use in describing an image synthesis of present invention.

(i) The CPU 29 stores display the coordinates indicating the vertexes of the display screen in the display position assignment register 16*a* of the dynamic frame memory 16 and in the display position assignment register 15*a* of the image combining unit 15. For example, in FIG. 3, the display coordinates (DX, DY) indicating a point A are stored. Further, the CPU 29 stores the height size and the width size of the window in the display size assignment register 16*b* of the dynamic frame memory 16 and in the display size assignment register 15*b* of the image combining unit 15. For example, in FIG. 3, DH and DW are stored.

(ii) As the display clock signal producing unit 13 produces a clock signal for recognizing the vertexes of the display screen, the static image frame memory 14 reads out one of the static image element data indicating vertexes of the display screen to output to the image combining unit 15. Furthermore, as the display clock signal producing unit 13 produces the clock signal for indicating an image element to the window, the static image frame memory 14 reads out another one of the static image element data stored in an address to output to the image combining unit 15. The address is next to a top address in which the static image element data has been just read out from the frame memory 14*a*.

(iii) As the display clock signal producing unit 13 produces the clock signal for recognizing the vertexes of the display screen, the dynamic image frame memory 16 examines whether or not one the dynamic image element data to be indicated as a window is stored in the top address of the frame memory 16*d*. If the dynamic image element data is stored, the dynamic image frame memory 16 reads out the data from the frame memory 16*a* to output the image combining unit 15. Furthermore, the display clock signal producing unit 13 for indicating a image element to the window, the dynamic image frame memory 16 examines whether or not another one of the dynamic image data to be indicated as a window is stored in the address which is next to the top address. If the dynamic image element data is stored, the dynamic image frame memory 16 reads out the data from the frame memory 16*a* to output the image combining unit 15.

(iv) As the display clock signal producing unit 13 produces the clock signal for recognizing the vertexes of the display screen, the image combining unit 15 determines to the top address of the display screen whether or not the window should be displayed according to the values of the display position assignment register 15*a* and the display size assignment register 15*b*. If the image combining unit 15 determined that the window should be displayed, the dynamic image element data are outputted to the D/A converter 18. If the image combining unit 15 has determined that the window should not be displayed, the static image element data are outputted to the D/A converter 18. Furthermore, as the display clock signal producing unit 13 produces the clock signal for indicating an image element to the window, the image combining unit 15 determines to an address which is next to the top address whether or not the window should be displayed according to the values of the display position assignment register 15*a* and the display size assignment register 15*b*. If the image combining unit 15 has determined that the window should be displayed, the dynamic image element data are outputted to the D/A converter 18. If the image combining unit 15 has determined that the window should not be displayed, the static image element data are outputted to the D/A converter 18.

(v) The display 19 displays the analog image signal outputted from the D/A converter 18.

Second Embodiment

In a second embodiment, it is assumed that a feeling of speed for a movement of dynamic image is higher and higher as a display area size of a window being displayed is smaller even if the dynamic image is the same dynamic image. The feeling of speed is amended by displaying frames each of which has been read out every predetermined number of frames.

In the second embodiment, the window has a rectangle and the term "display area size" is used as a length of a diagonal line of the window.

(Construction of the second embodiment)

Figure 7:
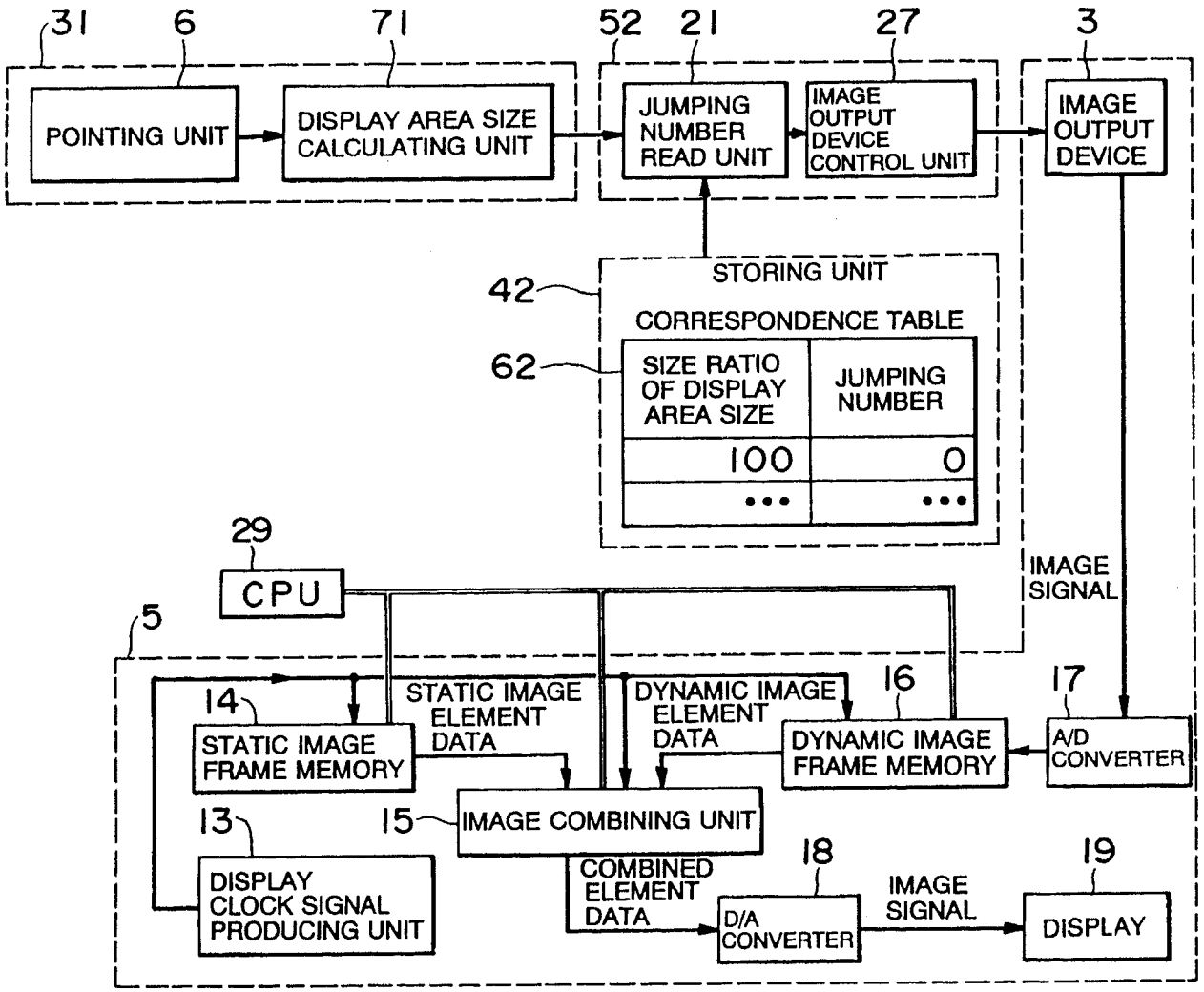
FIG. 7 is a structural block diagram showing a second embodiment of the present invention.

The description will now be made as regard to a construction of the second embodiment referring to FIG. 7.

The second embodiment comprises the followings (i)~(iv):

(i) A display unit 5 combining each of frames read out every predetermined jumping number from dynamic image data stored as successive frames in a VTR tape with each of frames produced from static image data by functions of a microprocessor and a frame memory to display each of combined frames in a window of a display at each of predetermined display periods;

(ii) A display area size input unit 31 for inputting a display area size of the window by a pointing unit;

(iii) A storing unit 42 for storing a relationship 62 between the display area size and the jumping number into a semiconductor memory; and, (iv) A dynamic image display controlling unit 52 reading out from the storing unit 42 by functions of an interface unit and a microprocessor the jumping number corresponding to the display area size inputted into the display area size input unit 31 to control so as to read out from he dynamic image data each of the combined frames every jumping number read out.

The description will now be made in detail as regard to the construction of the second embodiment.

As the constructions of the display area size input unit 31 and the display unit 5 are same as that of the first embodiment, the description with regard to the constructions is omitted.

The storing unit 42 has a correspondence table 62. (See FIG. 8)

The dynamic display controlling unit 52 comprises a jumping number read unit 21 and an image output device control unit 27.

The jumping number read unit 21 inputs the size ratio of the display area size calculated by the display area size calculating unit 71 to read out from the table of the storing unit 42 the jumping number corresponding to the size ratio of the display area inputted. The image output device control unit 27 is connected to the jumping number read unit 21.

The image output device control unit 27 controls to read out each frame from the dynamic image data every jumping number calculated by the jumping number read unit 21. The image output device 3 is connected to the image output device control unit 27.

(Function of The Second Embodiment)

Figures 8, 9:
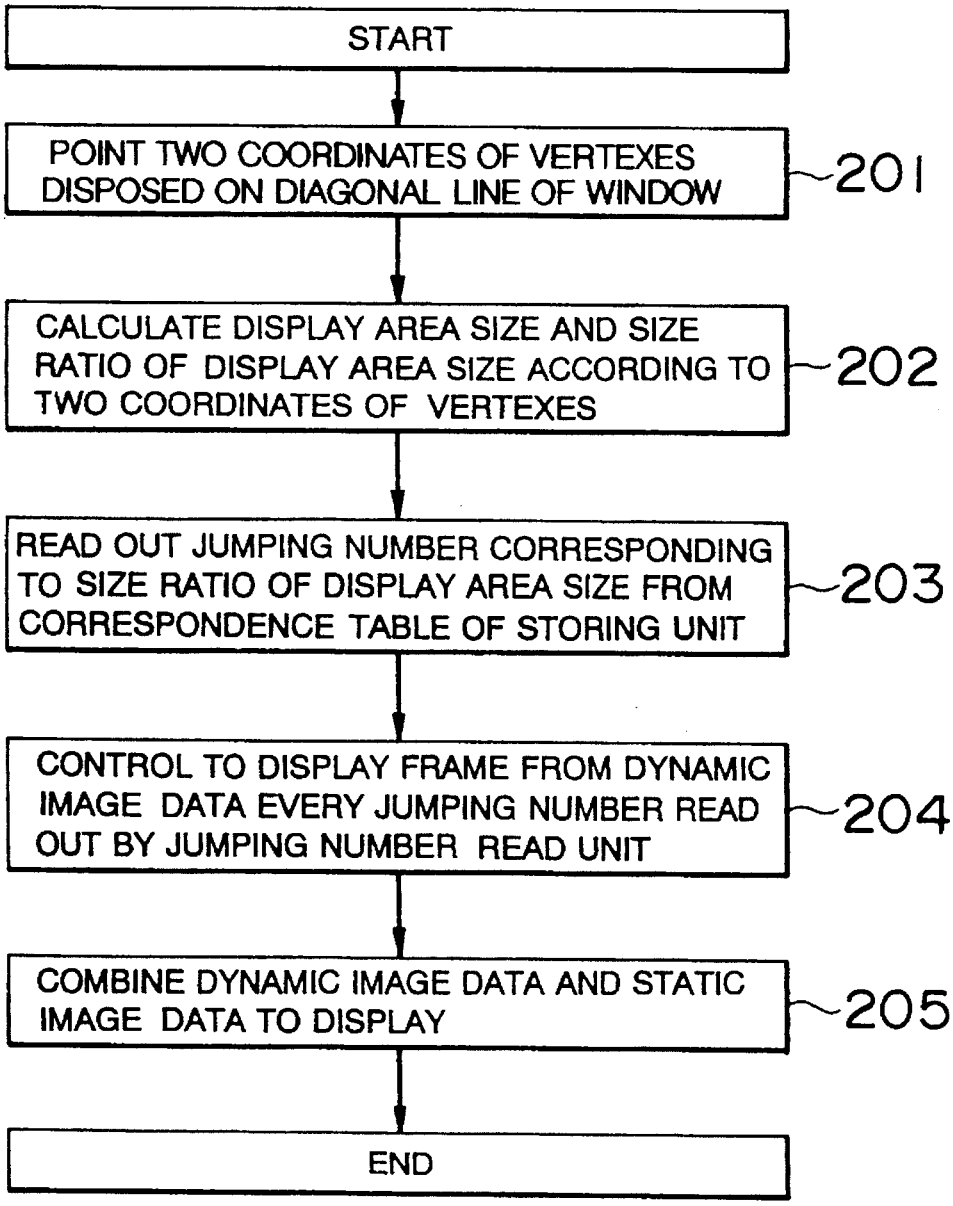
FIG. 8 is a view for use in corresponding a size ratio of the display area size with the jumping number according to the second embodiment of the present invention.
FIG. 9 is a flow chart showing the second embodiment of the present invention.

The operational routine of the second embodiment will be now described referring to a flow chart of FIG. 9.

First, the pointing unit 6 points coordinates indicating two vertexes disposed on a diagonal line of the window. (Step 201)

The display area size calculating unit 71 then calculates the distance between the two coordinates designated by the pointing unit 6, i.e. the display area size, and calculates the size ratio of the display area size according to the display area size calculated (Step 202).

Next, the jumping number read unit 21 inputs the size ratio of the display area size calculated by the display area size calculating unit 71 to read out from the table 64 of the storing unit 44 the jumping number corresponding to the size ratio of the display area size inputted (Step 203). For example, in FIG. 8, a value of 1 is read out as the jumping number when the size ratio of the display area size is 90.

The image output device control unit 27 controls to read out each frame from the dynamic image data every jumping number read out by the jumping number read unit 21 (Step 204).

Next, the display unit 5 combines the static image data with the dynamic image data to display the combined image data by processing the same routine of Step 105 according to the first embodiment (Step 205).

Third Embodiment

In the third embodiment, it is assumed that a feeling of speed for a movement of a dynamic image is higher and higher as the dynamic image outputted from a dynamic image display device is displayed on the display having a bigger display screen size. The feeling of speed is amended by changing a display period of a frame.

In the third embodiment, the term "display screen size" is used as a length of a diagonal line of the display screen.

(Construction of the third embodiment)

Figure 10:
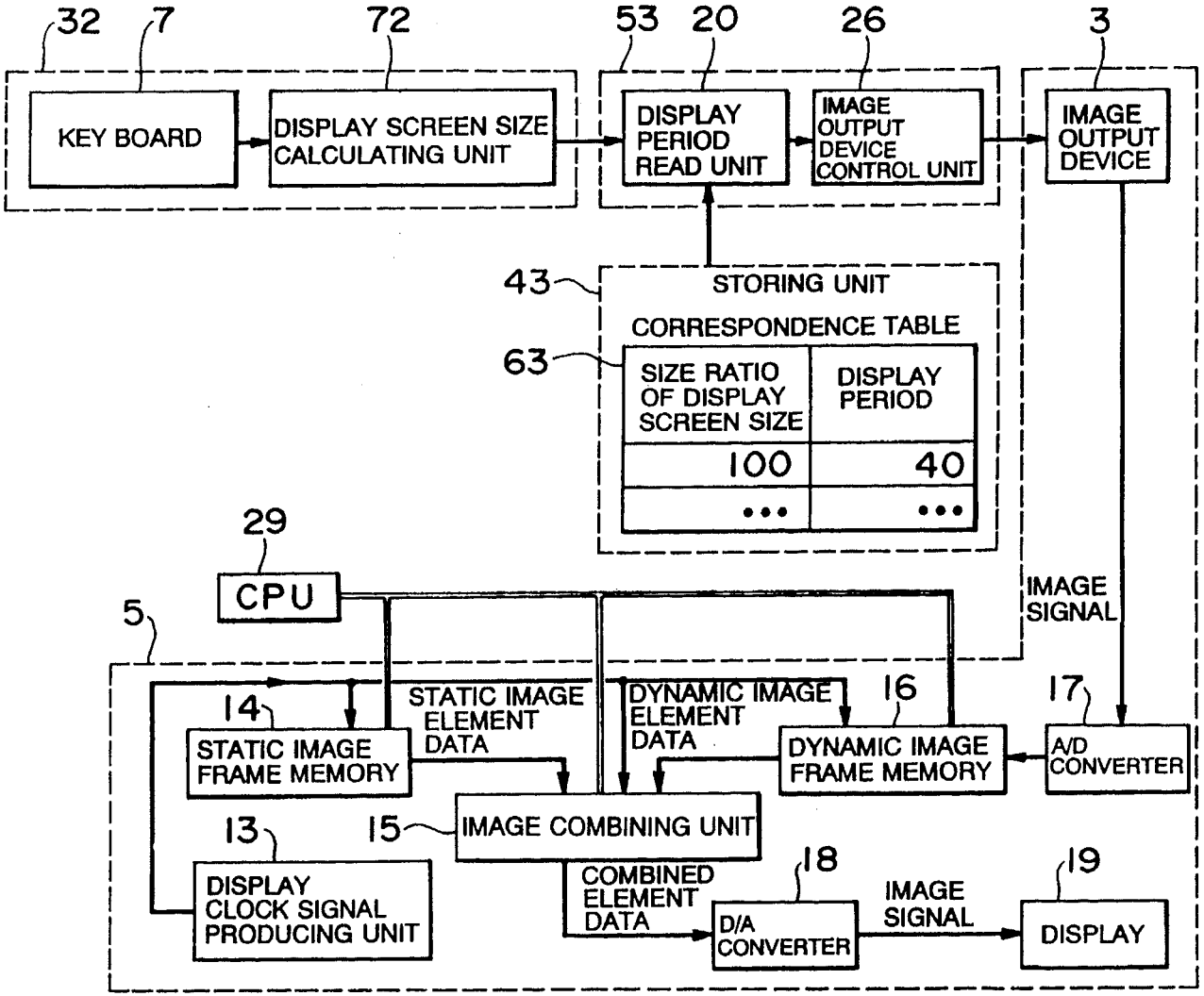
FIG. 10 is a structural block diagram showing a third embodiment of the present invention.

The description will now be made as regard to a construction of the third embodiment referring to FIG. 10.

The third embodiment comprises the followings (i)~(iv):

(i) A display unit 5 combining each of frames successively read out from dynamic image data stored as successive frames in a VTR tape with each of frames produced from static image data by functions of a microprocessor and a frame memory to display each of combined frames in a window of a display at each of predetermined display periods (ii) A display screen size input unit 32 for inputting a display screen size of the window by a key board;

(iii) A storing unit 43 for storing a relationship 63 between the display screen size and the display period into a semiconductor memory; and, (iv) A dynamic image display controlling unit 53 reading out from the storing unit 43 by functions of an interface unit and a microprocessor each of the display periods corresponding to the display screen size inputted in the display screen size input unit 32 to control so as to display each of the combined frames on the window of the display unit 5 at each of the display periods read out.

The description will now be made in detail as regard to the construction of the third embodiment.

As the construction of the display unit 5 is same as that of the first embodiment, the description with regard to the construction is omitted.

The display screen size input unit 32 comprises the key board and the display screen size calculating unit 72.

Figures 11, 12:
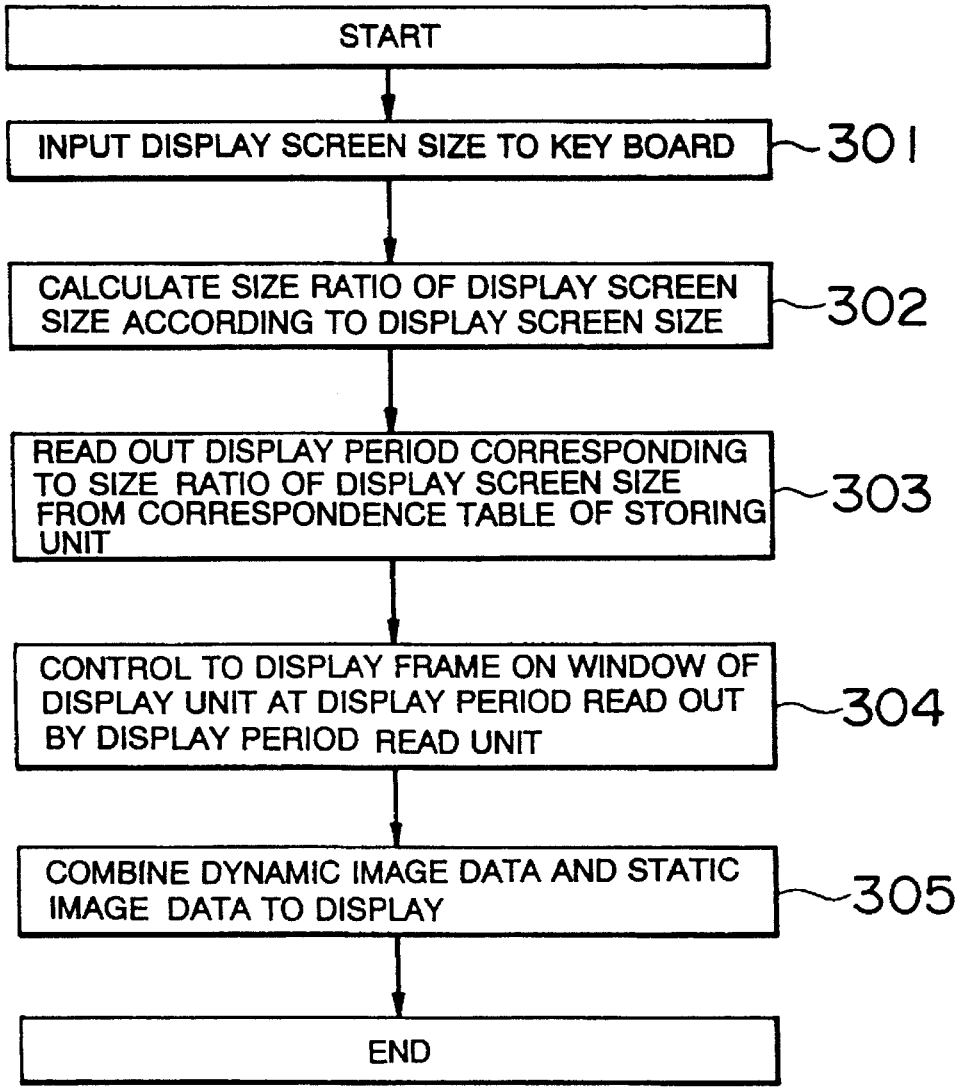
FIG. 11 is a view for use in corresponding a size ratio of the display area size with the display period according to the third embodiment of the present invention.
FIG. 12 is a flow chart showing the third embodiment of the present invention.

The storing unit 43 has a correspondence table 63 (See FIG. 11).

The dynamic image display controlling unit 53 comprises the display period read unit 20 and the image output device control unit 26.

The key board 7 inputs the display screen size in numbers. A numerical setting switch may be used instead of the key board 7. the display screen size calculating unit 72 is connected to the key board 7.

The display screen-size calculating unit 72 calculates a size ratio of the display screen size according to the display screen size inputted to the key board 7. The size ratio of the display screen size is a percentage of the actual display size against the maximum display screen size to be previously estimated. The display period read unit 20 is connected to the display screen size calculating unit 72.

The display period read unit 20 inputs the size ratio of the display screen size calculated by the display screen size calculating unit 72 to read out from a table 63 of the storing unit 43 the display period corresponding to the size ratio of the display screen size inputted. The image output device control unit 26 is connected to the display period read unit 20.

The image output device control unit 26 controls to display each of the combined frames on the window of the display unit 5 at each of the display periods read out by the display period read unit 20. The image output device 3 is connected to the image output device control unit 26.

(Function of The Third Embodiment)

The operational routine of the third embodiment will be now described referring to a flow chart of FIG. 12

First, the key board 7 inputs the size ratio of the display screen size calculated by the display screen size calculating unit 72 to read out from the table 63 of the storing unit 43 the display period corresponding to the size ratio of the display screen size inputted (Step 303). For example, in FIG. 11, a value of 39(msec/frame) is read out as the display period when the size ratio of the display screen size is 90.

The image output device control unit 26 controls to display each of the combined frames on the window of the display unit 5 at each of the display periods read out by the display period read unit 20 (Step 304).

Next, the display unit 5 combines the static image data with the dynamic image data to display the combined image data by processing the same routine of Step 105 according to the first embodiment (Step 305).

Fourth Embodiment

In the fourth embodiment, it is assumed that a feeling of speed for a movement of a dynamic image is higher and higher as the dynamic image outputted from a dynamic image display device is displayed on the display having a bigger display screen size. The feeling of speed is amended by displaying frames each of which has been read out every predetermined number of frames.

In the fourth embodiment, the term "display screen size" is used as a length of a diagonal line of the display screen.

(Construction of The Fourth Embodiment)

Figure 13:
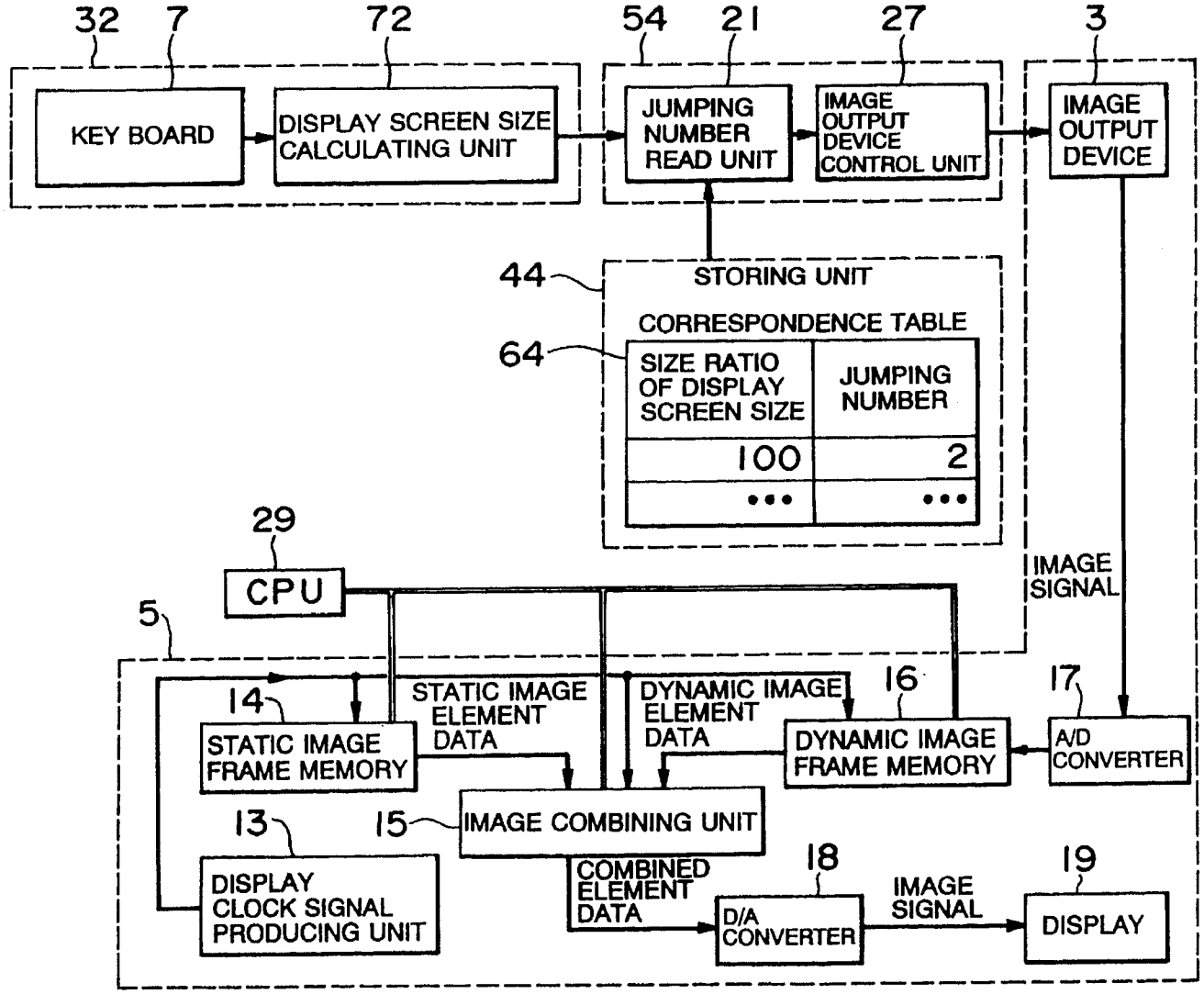
FIG. 13 is a structural block diagram showing a fourth embodiment of the present invention.

The description will now be made as regard to a construction of the fourth embodiment referring to FIG. 13.

The fourth embodiment comprises the followings (i)~(iv):

(i) A display unit 5 combining each of frames read out every predetermined jumping number from dynamic image data stored as successive frames in a VTR tape with each of frames produced from static image data by functions of a microprocessor and a frame memory to display each of combined frames on a window of a display at each of predetermined display periods;

(ii) A display screen size input unit 32 for inputting a display screen size of the window by a key board;

(iii) A storing unit 44 for storing a relationship 64 between the display screen size and the jumping number into a semiconductor memory; and, (iv) A dynamic image display controlling unit 54 reading out from the storing unit 44 by functions of an interface unit and a microprocessor the jumping number corresponding to the display screen size inputted into the display screen size input unit 32 and controlling to read out from the dynamic image data each of the combined frames every jumping number read out.

The description will now be made in detail as regard to the construction of the fourth embodiment.

As the construction of the display screen size input unit 32 is same as that of the third embodiment, the description with regard to the constructions is omitted. As the construction of the display unit 5 is same as that of the first embodiment, the description with regard to the constructions is omitted.

Figures 14, 15:
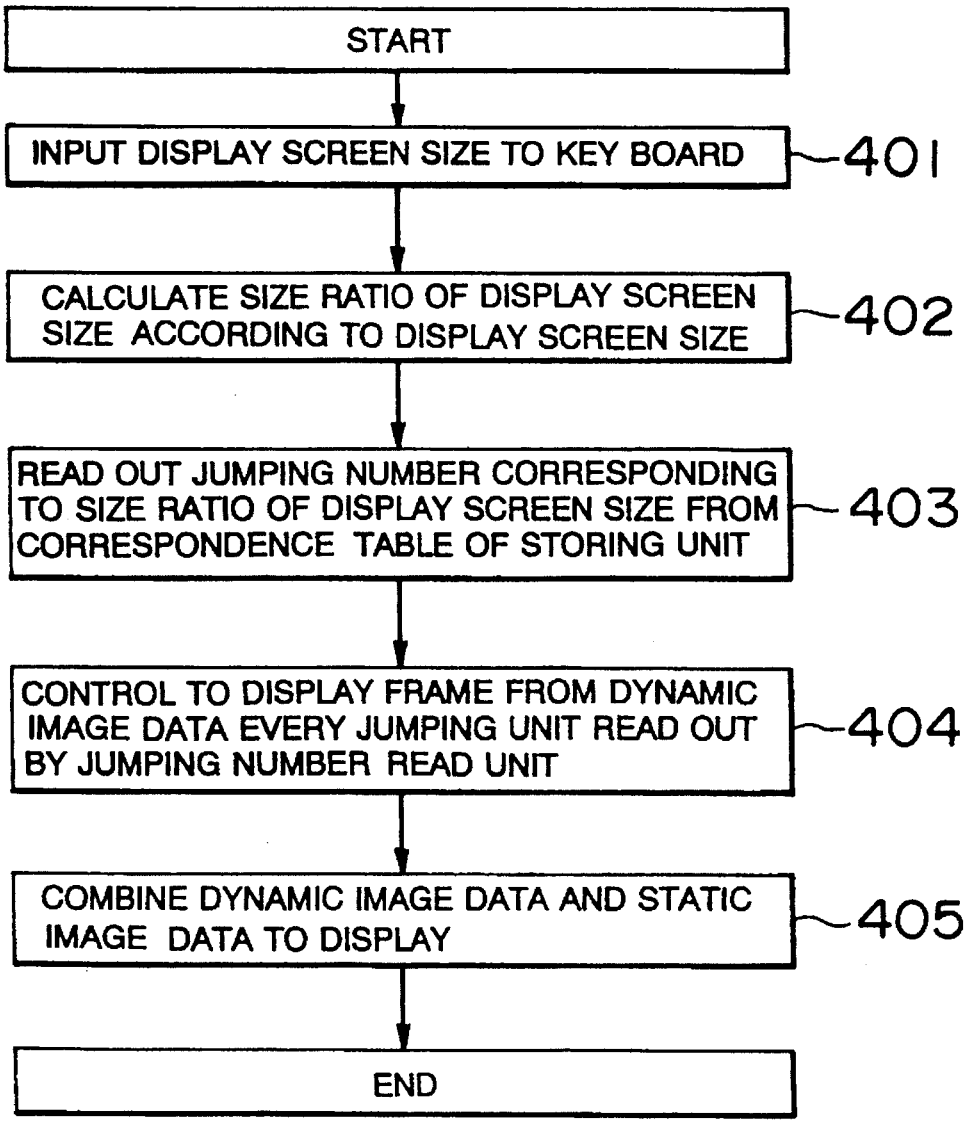
FIG. 14 is a view for use in corresponding a size ratio of the display area size with the jumping number according to the fourth embodiment of the present invention.
FIG. 15 is a flow chart showing the fourth embodiment of the present invention.

The storing unit 44 has a correspondence table 64 (See FIG. 14).

The dynamic display controlling unit 54 reads out the jumping number corresponding to the size ratio of the display screen size and controls to read out each of the frames from the dynamic image data every jumping number. The dynamic display controlling unit 54 comprises the jumping number read unit 21 and the image output device control unit 27.

The jumping number read unit 21 inputs the size ratio of the display screen size calculated by the display screen size calculating unit 72 to read out from the table 64 of the storing unit 44 the jumping number corresponding to the size ratio of the display screen size inputted. The image output device control unit 27 is connected to the jumping number read unit 21.

The image output device control unit 27 controls to read out each frame from the dynamic image data every jumping number read out by the jumping number read unit 21. The image output device 3 is connected to the image output device control unit 27.

(Function of The fourth Embodiment)

The operational routine of the fourth embodiment will be now described referring to a flow chart of FIG. 15.

First, the key board 7 inputs the display screen size (Step 401). The display screen size calculating unit 72 then calculates the size ratio of the display screen size according to the display screen size inputted in the key board 7 (Step 402).

Next, the jumping number read unit 21 inputs the size ratio of the display screen size calculated by the display screen size calculating unit 72 to read out from the table 6 of the storing unit 42 the jumping number corresponding to the size ratio of the display screen size inputted (Step 403). For example, in FIG. 14, a value of 1 is read out as the jumping number when the size ratio of the display screen size is 90.

The image output device control unit 27 controls to display each of the combined frames every jumping number read out by the jumping number read unit 21 (Step 404).

Next, the display unit 5 combines the static image data with the dynamic image data to display the combined image data by processing the same routine of Step 105 according to the first embodiment (Step 405).

Fifth Embodiment

In the fifth embodiment, it is assumed that a feeling of speed for a movement of a dynamic image is higher and higher as the dynamic image reflected in the users eye is smaller in case of that the distance between the display screen displaying the windows and the user looking the dynamic image. The feeling of speed is amended by changing the display period of frames.

In the fifth embodiment, the term "distance parameter" is used as a following meaning. That is, the distance parameter is a value calculated by the following equation (5–1) wherein DX indicates a distance between the display screen displaying the windows and the user looking the dynamic image and DISPH indicates a height length of the display screen of the display unit 5.

$$\tan^{-1}(DISPH/2DX) \qquad (5\text{–}1)$$

(Construction of The Fifth Embodiment)

Figure 16:
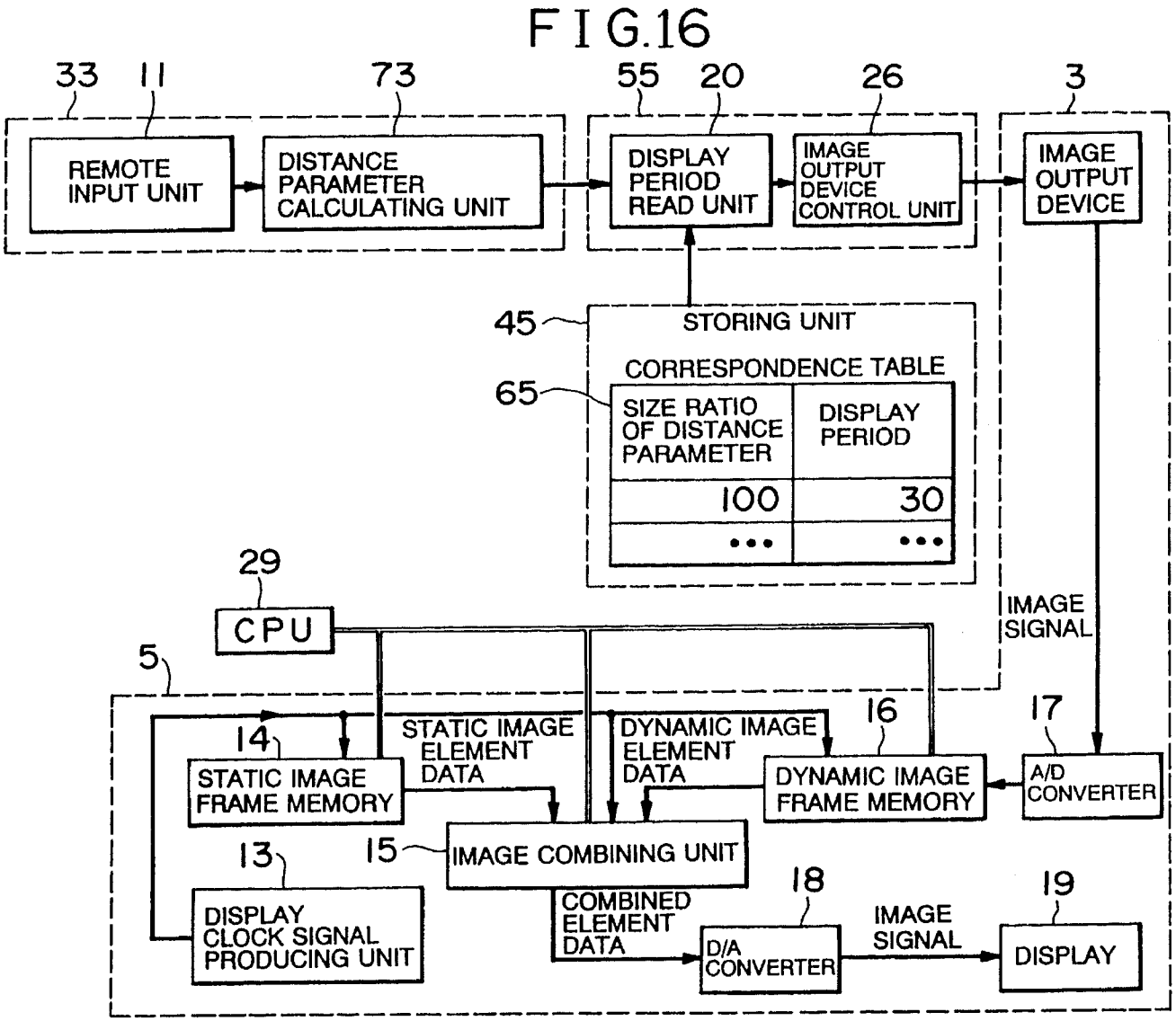
FIG. 16 is a structural block diagram showing a fifth embodiment of the present invention.

The description will now be made as regard to a construction of the fifth embodiment referring to FIG. 16.

The fifth embodiment comprises the followings (i)~(iv):

(i) A display unit 5 combining each of frames successively read out from dynamic image data stored as successive frames in a VTR tape with each of frames produced from static image data by functions of a microprocessor and a frame memory to display each of combined frames on a window of a display at each of predetermined display periods;

(ii) A distance parameter input unit 33 for inputting as a distance parameter a distance between the display screen displaying the window and the user looking the dynamic image by a key board.

(iii) A storing unit 45 for storing a relationship 65 between the distance parameter and the display period into a semiconductor memory.

(iv) A dynamic image display controlling unit 55 reading out from the storing unit 44 by functions of an interface unit and a microprocessor each of the display periods corresponding to the distance parameter inputted in the distance parameter input unit 33 to control so as to display each of the combined frames on the window at each of the display period.

The description will now be made in detail as regard to the construction of the fifth embodiment.

As the construction of the display unit 5 is same as that of the first embodiment, the description with regard to the construction is omitted.

The distance parameter input unit 33 comprises a remote input unit 11 and a distance parameter calculating unit 73.

Figures 17, 18:
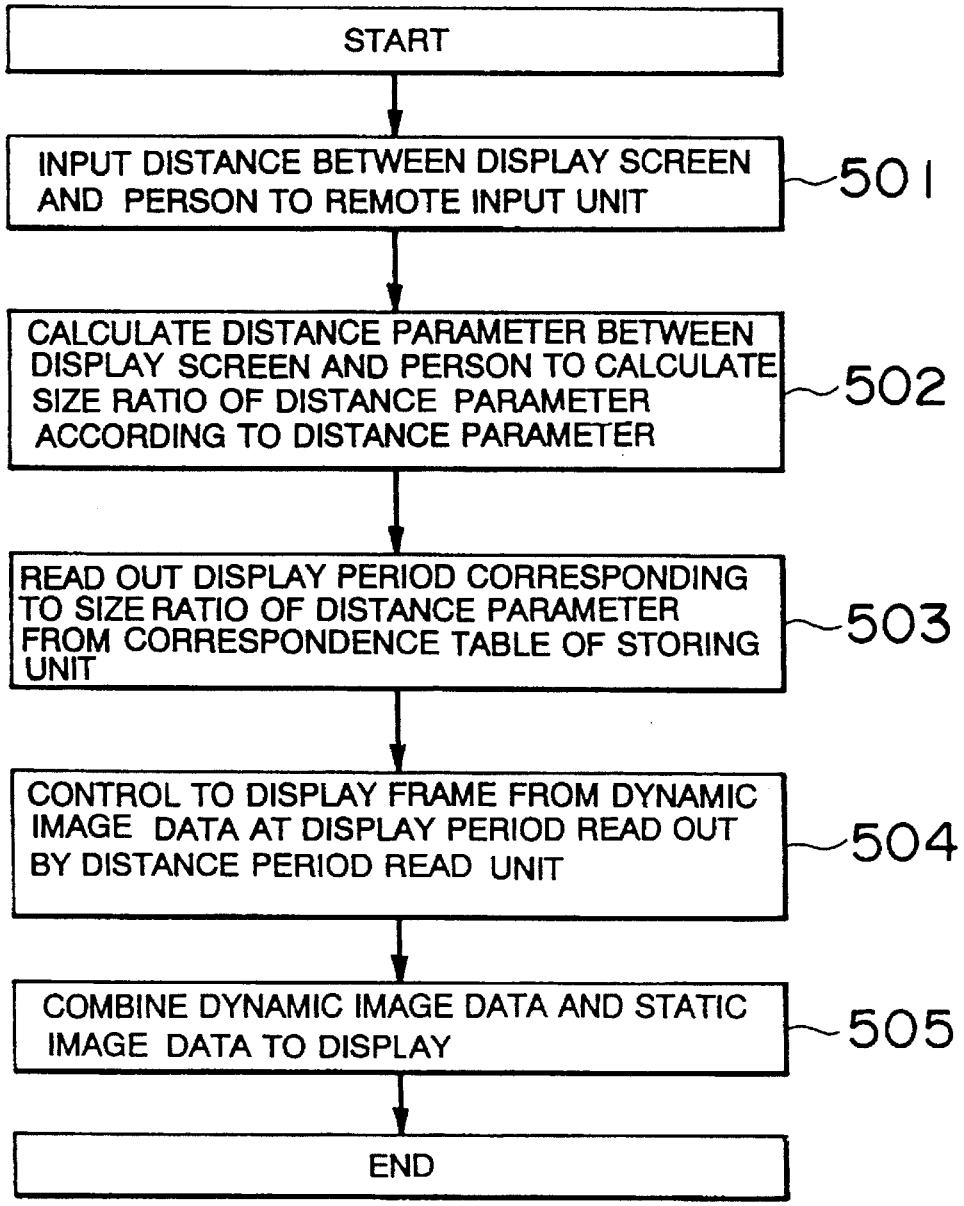
FIG. 17 is a view for use in corresponding a size ratio of the display area size with the display period according to the fifth embodiment of the present invention.
FIG. 18 is a flow chart showing the fifth embodiment of the present invention.

The storing unit 45 has a correspondence table 65 (See FIG. 17).

The dynamic display control unit 55 comprises the display period read unit 20 and the image output device control unit 26.

The remote input unit 11 inputs the distance between the display screen displaying a window and the user looking the dynamic image even if apart from the display screen. The remote input unit 11 may be a key board or a numerical setting switch which use a radio transmission instead of a cable. It is obvious that the remote input unit 11 may be also a key board or a numerical setting switch which use a long cable. The distance parameter calculating unit 73 is connected to the remote input unit 11.

The distance parameter calculating unit 73 calculates the distance parameter according to the distance between the display screen displaying the window and the user looking the dynamic image which is inputted in the remote input unit 11 and calculates the size ratio of the distance parameter according to the distance parameter calculated. The size ratio of the distance parameter is a percentage of the actual distance parameter against the maximum distance parameter to be previously estimated. The display period read unit 20 is connected to the distance parameter calculating unit 73.

The display period read unit 20 inputs the size ratio of the distance parameter calculated by the distance parameter calculating unit 73 to read out from the table 65 of the storing unit 45 the display period corresponding to the size ratio of the distance parameter inputted. The image output device control unit is connected to the display period read unit 20.

The image output device control unit 26 controls to display each of the frames on the window of the display unit 5 at each of the display period read out by the display period read unit 20. The image output device 3 is connected to the image output device control unit 26.

(Function of The Fifth Embodiment)

The operational routine of the fifth embodiment will be now described referring to a flow chart of FIG. 18.

First, the remote input unit 11 inputs the distance between the display screen displaying the window and the user looking the dynamic image even if apart from the display screen (Step 501).

The distance parameter calculating unit 73 calculates the distance parameter according to the distance between the display screen and the user which is inputted in the remote input unit and calculates the size ratio of the distance parameter according to the distance parameter calculated (Step 502).

Next, the display period read unit 20 inputs the size ratio of the distance parameter calculated by the distance parameter calculating unit 73 to read out from the table 65 of the storing unit 45 the display period corresponding to the size ratio of the distance parameter inputted (Step 503). For example, in FIG. 17, a value of 33(msec/frame) is read out as the display period in case of that the size ratio of the distance parameter is 90.

The image output device control unit 26 controls to display each of the frames on the window of the display unit 5 at each of the display period read out by the display period read unit 20 (Step 504).

Next, the display unit 5 combines the static image data with the dynamic image data to display the combined image data by processing the same routine of Step 105 according to the first embodiment (Step 505).

Sixth Embodiment

In the sixth embodiment, it is assumed that a feeling of speed for a movement of a dynamic image is higher and higher as the dynamic image reflected in the users eye is smaller in case of that the user looking the dynamic image. The feeling of speed is amended by displaying frames read out every predetermined number.

In the sixth embodiment, the term "distance parameter" is used as the meaning as mentioned in the fifth embodiment.

(Construction of The Sixth Embodiment)

The description will now be made as regard to a construction of the sixth embodiment referring to FIG. 19.

The sixth embodiment comprises the followings (i)~(iv).

(i) A display unit 5 for displaying each of combined frames in a window of a display at each of predetermined display period, each of the combined frames has been combined each of frames read out every predetermined jumping number from dynamic image data stored as successive frames in a VTR tape with each of frames produced from static image data by functions of a microprocessor and a frame memory.

(ii) A distance parameter input unit 33 for inputting as a distance parameter a distance between the display screen displaying the window and the user looking the dynamic image by a key board.

(iii) A storing unit 46 for storing a relationship between the distance parameter and the jumping number into a semiconductor memory.

(iv) A dynamic image display controlling unit 56 reading out from the storing unit 46 by functions of an interface unit and the microprocessor the jumping number corresponding to the distance parameter inputted in the distance parameter input unit 33 and controlling to read out each of the combined frames on the window every said jumping number from dynamic image data.

The description will now be made in detail as regard to the construction of the sixth embodiment.

As the construction of the distance parameter input unit 33 is same as that of the fifth embodiment, the description with regard to the construction is omitted.

Figures 20, 21:
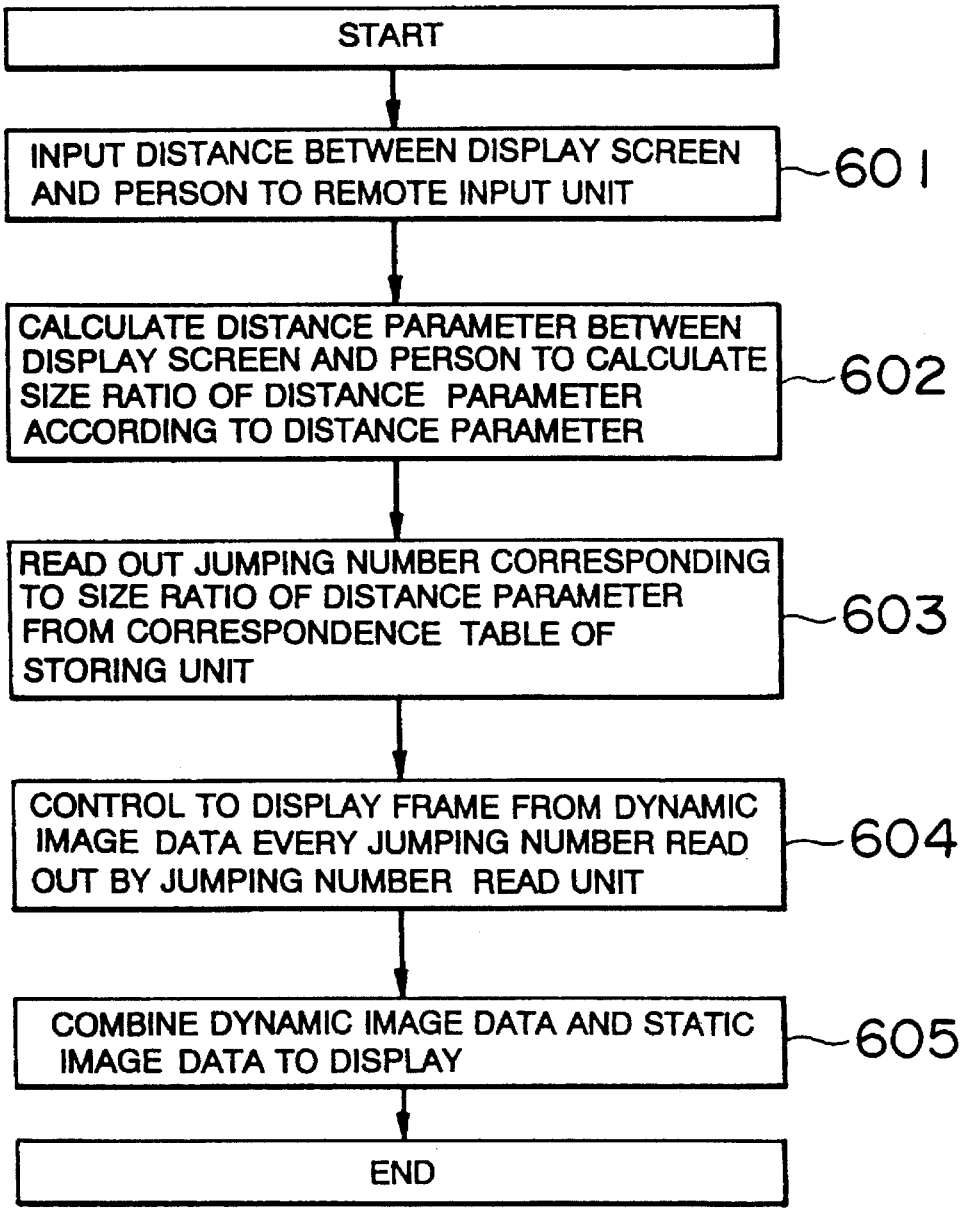
FIG. 20 is a view for use in corresponding a size ratio of the display area size with the jumping number according to the sixth embodiment of the present invention.
FIG. 21 is a flow chart showing the sixth embodiment of the present invention; and, FIG. 22 is a principle view for use in describing a distance parameter according to the fifth embodiment and the sixth embodiment.
Figure 22:
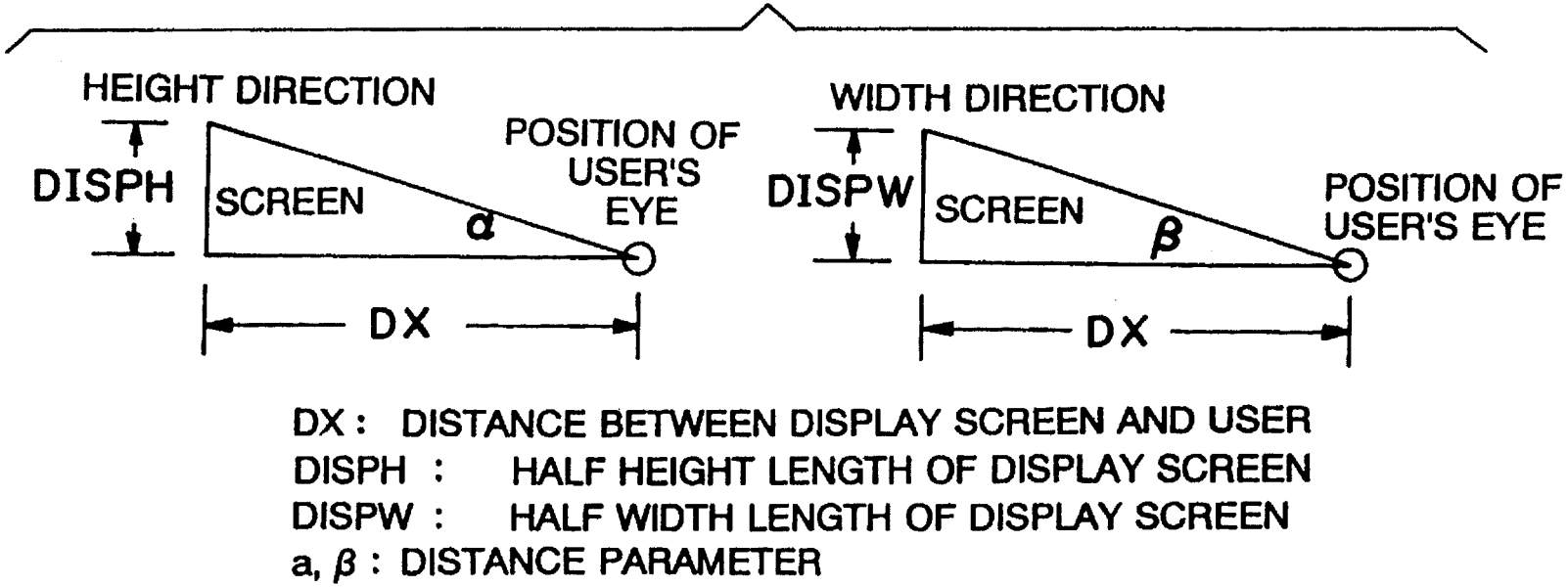

The storing unit 46 has a correspondence table 66 (see FIG. 20).

The dynamic image display controlling unit 56 reads out the jumping number corresponding to the size ratio of the distance parameter from the storing unit 46 and controls to read out from the dynamic image data each of the frames every jumping number read out. The dynamic image display controlling unit 56 comprises the jumping number read unit 21 and the image output device control unit 27.

The jumping number read unit 21 inputs the size ratio of the distance parameter calculated by the distance parameter calculating unit 73 to read out from the table 66 of the storing unit 46 the jumping number corresponding to the size ratio of the distance parameter. The image output device control unit 27 is connected to the jumping number read unit 21.

The image output device control unit 27 controls to read out each of the frames from the dynamic image data every jumping number read out by the jumping number read unit 21. The image output device 3 is connected to the image output device control unit 27.

(Function of The Sixth Embodiment)

The operational routine of the sixth embodiment will be now described referring to a flow chart of FIG. 21.

First, the remote input unit 11 inputs the distance between the display screen displaying the window and the user looking the dynamic image even if apart from the display screen (Step 601).

The distance parameter calculating unit 73 calculates the distance parameter according to the distance between the display screen and the user which is inputted in the remote input unit and calculates the size ratio of the distance parameter according to the distance parameter calculated (Step 602).

Next, the jumping number read unit 21 inputs the size ratio of the distance parameter calculated by the distance parameter calculating unit 73 to read out from the correspondence table 66 of the storing unit 46 the jumping number corresponding to the size ratio of the distance parameter inputted (Step 603). For example, in FIG. 20, a value of 1 is read out as the jumping number when the size ratio of the distance parameter is 90.

The image output device control unit 27 controls to read out each of the frames from the dynamic image data every jumping number read out by the jumping number read unit 21 (Step 604).

Next, the display unit 5 combines the static image data with the dynamic data to display the combined image data by processing the same routine of Step 105 according to the first embodiment (Step 605).

What is claimed is:

1. A dynamic image display device which successively reads out each of a plurality of frames from dynamic image data stored as successive frames to display each of said plurality of frames at each predetermined display period on a window of a display device, said predetermined display period being changeable, said dynamic image display device comprising:

distance parameter input unit for inputting a distance parameter between a display screen displaying said window and a person looking at a dynamic image on said display screen;

a storage device having a definition correlating said distance parameter with said predetermined display period;

means for reading out from said storage device said predetermined display period corresponding to said distance parameter inputted by said distance parameter input unit; and means for displaying each of said plurality of frames on said window of said display device during each said predetermined display period.

* * * * *